US007748707B2

(12) United States Patent
Giese

(10) Patent No.: US 7,748,707 B2
(45) Date of Patent: Jul. 6, 2010

(54) FEEDER ASSEMBLY EMPLOYING VERTICAL SHEET REGISTRATION

(75) Inventor: Troy A. Giese, North Hugo, MN (US)

(73) Assignee: Carestream Health, Inc., Rochester, NY (US)

( * ) Notice: Subject to any disclaimer, the term of this patent is extended or adjusted under 35 U.S.C. 154(b) by 619 days.

(21) Appl. No.: 11/611,314

(22) Filed: Dec. 15, 2006

(65) Prior Publication Data

US 2008/0143036 A1 Jun. 19, 2008

(51) Int. Cl.
*B65H 9/00* (2006.01)

(52) U.S. Cl. ..... 271/226; 271/228; 271/273

(58) Field of Classification Search ..... 271/228, 271/226, 273

See application file for complete search history.

(56) References Cited

U.S. PATENT DOCUMENTS

| | | | | |
|---|---|---|---|---|
| 4,687,362 | A | 8/1987 | Rünzi | |
| 4,986,527 | A | 1/1991 | Ogoda | |
| 5,062,726 | A | 11/1991 | Inomata et al. | |
| 5,427,462 | A | 6/1995 | Jackson et al. | |
| 5,466,079 | A | 11/1995 | Quintana | |
| 6,123,331 | A | 9/2000 | Vackier et al. | |
| 6,209,861 | B1 * | 4/2001 | Kakuta et al. | 271/3.02 |
| 6,585,439 | B2 * | 7/2003 | Johnson et al. | 400/642 |
| 7,068,969 | B2 * | 6/2006 | Ueda | 399/388 |
| 2004/0217542 | A1 | 11/2004 | Camacho | |
| 2007/0273091 | A1 | 11/2007 | Kamiya et al. | |
| 2008/0240821 | A1 * | 10/2008 | Shoji et al. | 399/395 |

FOREIGN PATENT DOCUMENTS

| | | | |
|---|---|---|---|
| EP | 1 624 346 | | 2/2006 |
| JP | 2006176263 | A * | 7/2006 |
| JP | 2007106572 | A * | 4/2007 |
| JP | 2008201553 | A * | 9/2008 |

* cited by examiner

*Primary Examiner*—Patrick Mackey
*Assistant Examiner*—Howard Sanders

(57) ABSTRACT

A method for deskewing a sheet. The method includes positioning a lower roller pair and at least one upper roller pair to form a substantially vertical transport path, wherein the lower roller pair and at least one upper roller pair each form a nip. The method includes driving the lower roller pair and the at least one upper roller pair so as to transport the sheet upward along the substantially vertical transport path, opening the nip formed by the at least one upper roller pair as a trailing edge of the sheet approaches the lower roller pair. The method further includes continuing to drive the lower roller pair so that the trailing edge passes through the nip formed by the lower roller pair and upward movement of the sheet ceases with the trailing edge supported by the lower roller pair, wherein gravity and continued rotation of the lower roller pair work together align the trailing edge with the lower roller pair.

20 Claims, 18 Drawing Sheets

FEEDER ASSEMBLY EMPLOYING VERTICAL SHEET REGISTRATION

FIELD OF THE INVENTION

The invention relates generally to the field of imaging, and in particular to an imaging apparatus employing sheet registration. More specifically, the invention relates to an imaging apparatus employing vertical sheet registration.

BACKGROUND OF THE INVENTION

Laser imagers are widely used in the medical imaging field to produce visual representations on film of digital medical images. Laser imagers typical include a media supply system, a feeder system, an exposure system, a processing system, an output system (e.g., output tray, sorter), and a transport system that moves film through the laser imager along a transport path from the media supply system to the output system. The media supply system generally includes a supply of film sheets stacked in one or more cartridges or trays and an extractor or pickup assembly for removing individual sheets from the trays for delivery to the feeder assembly.

When transferring sheets from the pickup assembly to the transport path, it is important that the for the feeder system to properly align the sheets. A sheet that is delivered at an angle (i.e. skewed) and/or laterally misaligned (e.g. off-center) relative to the transport path can cause an image to be improperly produced on the sheet by the exposure system and may result in jams along the transport path. As such, several techniques have been employed by feeder systems to achieve proper film alignment.

One such technique involves transporting a sheet along a curved transport path via a pair of drive rollers. To align the sheet with the transport path, the sheet is passed through the drive rollers and drops to a stationary plate. The stationary plate is positioned at an angle so as to cause the sheet to slide down the stationary plate so that a transverse edge of the sheet contacts a stop. Conventional aligning plates are then actuated to move and laterally align the sheet with the transport path and cause the transverse edge to longitudinally align the sheet with the transport path through contact with the stop.

Laser imagers have typically separated the exposure the exposure and processing functions so that exposure of the sheet is completed prior to processing or development. However, in order to provide faster time to first print and to provide increased throughput, some laser imagers are now configured to begin processing a sheet while it is still being exposed, a so-called processing-while-imaging system. While the above described technique is generally effective at aligning sheets, dropping and sliding the sheet along the stationary plate is time consuming, and due to static charges, the sheet may not slide freely on the plate and, thus, not properly align with the stop.

While such systems may have achieved certain degrees of success in their particular applications, there is a need to provide an improved system and method for registering film, particularly for a processing-while-imaging type imaging apparatus.

SUMMARY OF THE INVENTION

An object of the present invention is to provide sheet registration with reduced travel and registration times so as to decrease time to first print and increase throughput of a corresponding imaging apparatus.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

According to one aspect of the invention, there is provided a method for deskewing a sheet. The method includes positioning a lower roller pair and at least one upper roller pair to form a substantially vertical transport path, wherein the lower roller pair and at least one upper roller pair each form a nip. The method further includes driving the lower roller pair and the at least one upper roller pair so as to transport a sheet upward along the substantially vertical transport path, opening the nip formed by the at least one upper roller pair as a trailing edge of the sheet approaches the lower roller pair, and continuing to drive the lower roller pair so that the trailing edge passes through the nip formed by the lower roller pair and upward movement of the sheet ceases with the trailing edge supported by the lower roller pair, wherein gravity and continued rotation of the lower roller pair work together align the trailing edge with the lower roller pair.

According to once aspect of the invention, the method includes moving the sheet laterally to a desired lateral position relative to the substantially vertical transport path as the lower roller pair continues to be driven.

According to one aspect of the invention, the method includes stopping the driving of the lower roller pair and the at least one upper roller pair after the trailing edge is aligned with the lower roller pair and moved to the desired lateral position, closing the nip formed by the at least one upper roller pair, and restarting the driving of the lower roller pair and the at least one upper roller pair so as to transport the aligned sheet upward along the substantially vertical transport path.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
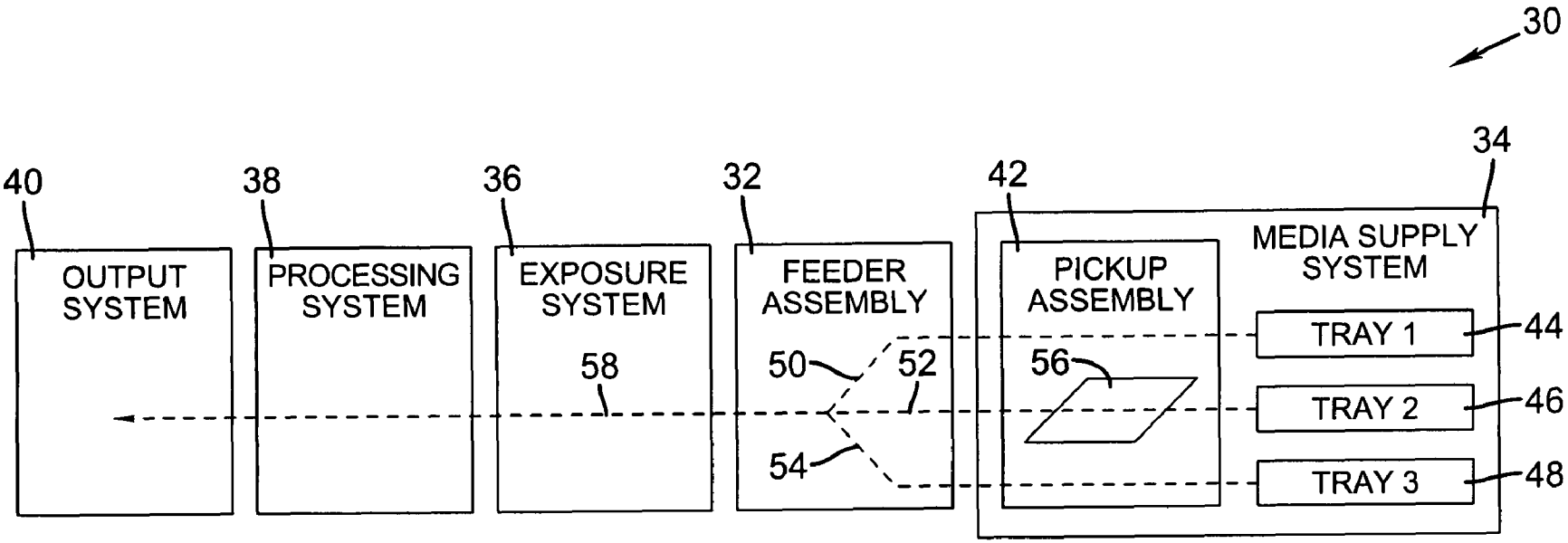
FIG. 1 illustrates a block diagram illustrating an example of an imaging apparatus employing a feeder assembly according to the present invention.

The following is a detailed description of the preferred embodiments of the invention, reference being made to drawings in which the same reference numerals identify the same elements of structure in each of the several figures.

FIG. 1 is block diagram illustrating generally an example of an imaging apparatus 30 employing a feeder assembly 32 providing vertical sheet registration with a turning roller pair according to embodiments of the present invention. In addition to feeder assembly 32, imaging apparatus 30 includes a media supply system 34, an exposure system 36, a processing system 38, and an output system 40. Media supply system 34 further includes a pickup assembly 42 and a plurality of media trays, illustrated as first media tray 44, second media tray 46, and third media tray 48, with each media tray holding a stack of sheets of unexposed imaging media. In one embodiment, each media tray 44, 46, and 48 holds a different size of sheets of imaging media.

Pickup assembly 42 is configured to remove individual sheets of imaging media from each of the media trays 44, 46, and 48 and to provide the sheets of imaging to feeder assembly 32 along a corresponding transport path, illustrated as transport paths 50, 52, and 54. In one embodiment, as illustrated by FIG. 1, pickup assembly 42 removes a sheet of imaging media, illustrated as sheet 56, from second media tray 46 and delivers sheet 56 to feeder assembly 32 along corresponding transport path 52. Feeder assembly 32 receives sheet 56 and, as will be described in greater detail below, employs vertical sheet registration and a turning roller pair, according to embodiments of the present invention, to longitudinally align (i.e. deskew) and transversely position (e.g. center) sheet 56 relative to a transport path 58.

Feeder assembly 32 delivers the registered (i.e. deskewed and centered) sheet 56 to exposure system 36 via transport path 58. Exposure system 36 subsequently exposes a desired photographic image on sheet 56 based on image data (e.g. digital or analog) to form a latent image of the desired photographic image on sheet 56. In one embodiment, exposure system 36 comprises a laser imager. Processing system 38 receives exposed sheet 56 from exposure system 36 via transport path 58 and develops the latent image. In one embodiment, processing system 38 comprises a thermal processor (e.g. a drum-type processor, drum and flatbed type) which heats the exposed sheet 56 to thermally develop the latent image. The developed film is cooled and moved by processing system 38 to output system 40 (e.g. a tray or sorter system). An example of an imaging apparatus similar to that described above by imaging apparatus 30 and suitable to be configured for use with feeder assembly 32 according to embodiments of the present invention is described by U.S. Pat. No. 6,007,971 to Star et al., which is herein incorporated by reference.

Figure 2:
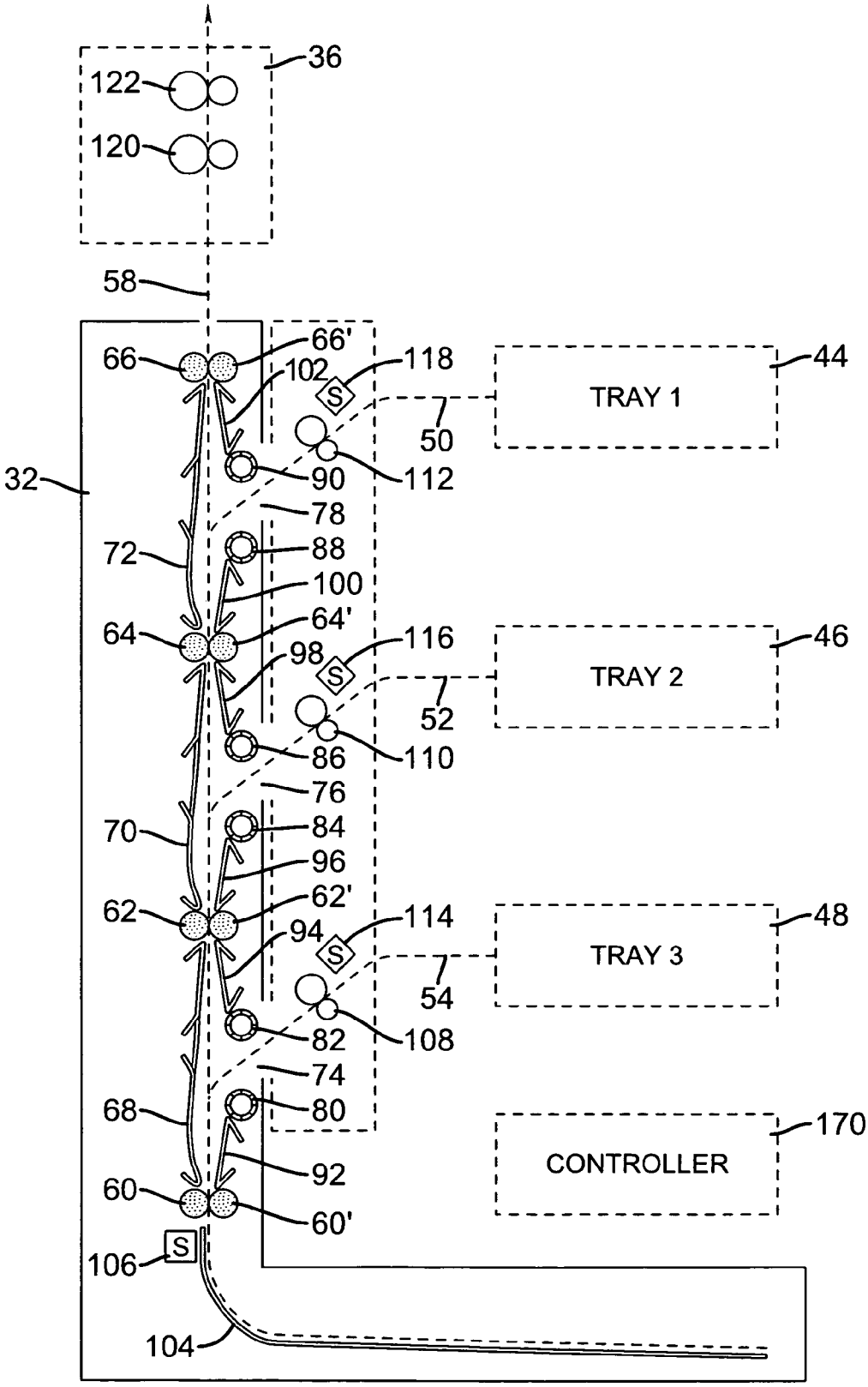
FIG. 2 illustrates a schematic diagram illustrating a side view of one embodiment of a feeder assembly according to the present invention.
Figure 3:
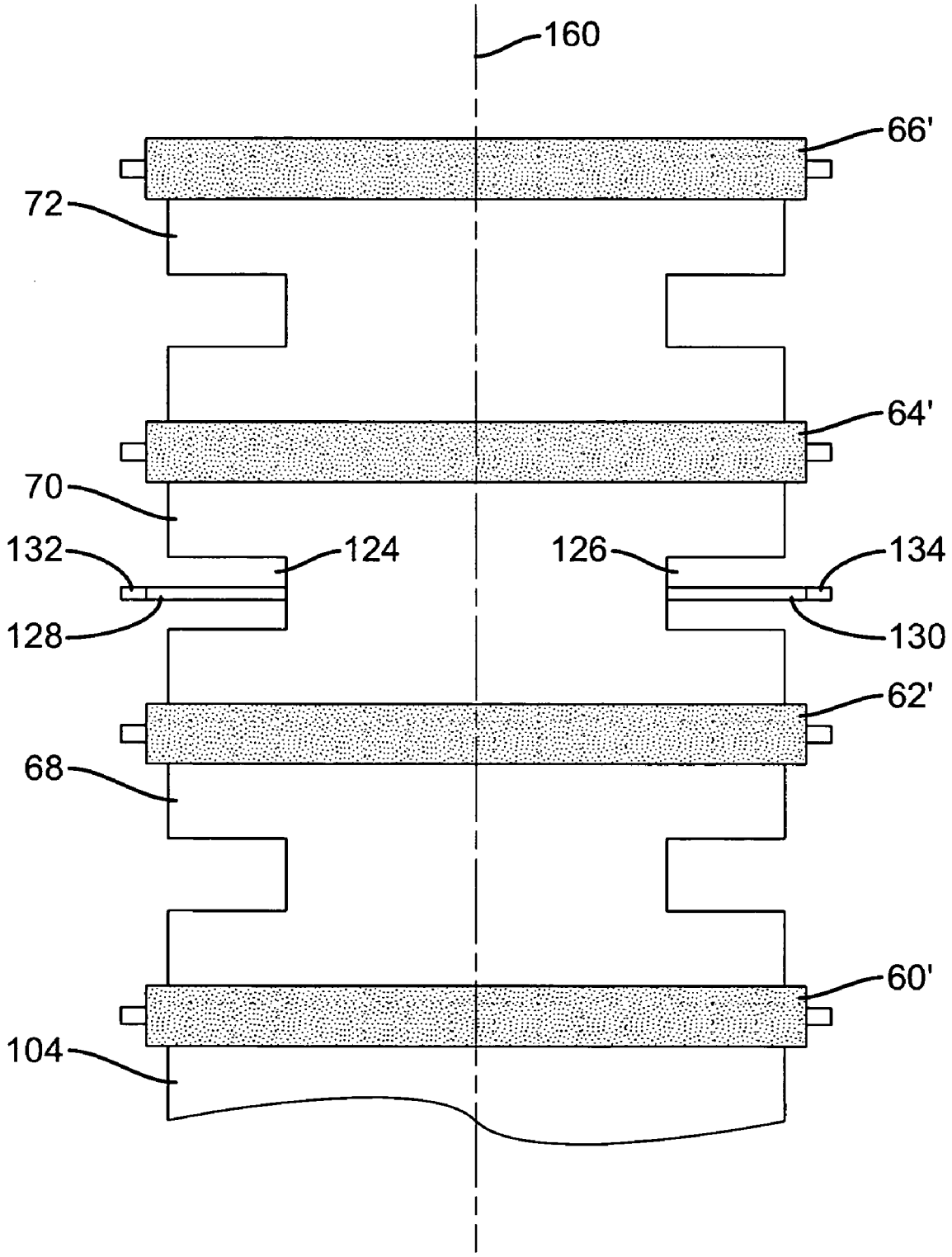
FIG. 3 illustrates a front view of the feeder assembly of FIG. 2.

FIGS. 2 and 3 are block and schematic diagrams illustrating generally one embodiment of feeder assembly 32 according to the present invention. FIG. 2 is a side view of feeder assembly 32. Feeder assembly 32 includes a lower driven roller pair 60, 60', and a plurality of upper roller pairs, illustrated as roller pair 62, 62', roller pair 64, 64', and roller pair 66, 66'. In one embodiment, rollers 62, 64, and 66 are driven rollers and rollers 62', 64', and 66' are non-driven idler rollers which are moveable between a closed position and an open position. In the closed position, as illustrated by FIG. 2, idler rollers 62', 64', and 66' form a nip with corresponding rollers 62, 64, and 66, such that when rollers 62, 64, and 66 are driven, idler rollers 62', 64', and 66' turn so to transport sheets along transport path 58. A guide 68 is positioned between roller pair 60, 60' and roller pair 62, 62', a guide 70 is positioned between roller pair 62, 62' and roller pair 64, 64', and a guide 72 is positioned between roller pair 64, 64' and roller pair 66, 66'.

Feeder assembly 32 includes an entrance area 74 proximate to third tray 48, an entrance area 76 proximate to second tray 46, and an entrance area 78 proximate to first tray 44. Idler rollers 80 and 82 are positioned on opposite sides of entrance area 74, idler rollers 84 and 86 are positioned on opposite sides of entrance area 76, and idler rollers 88 and 90 are positioned on opposite sides of entrance area 78. A guide 92 is positioned between roller pair 60, 60' and idler roller 80, and a guide 94 is positioned between roller pair 62, 62' and idler roller 82. A guide 96 is positioned between roller pair 62, 62' and idler roller 84, and a guide 98 is positioned between roller pair 64, 64' and idler roller 86. A guide 100 is positioned between roller pair 64, 64' and idler roller 88, and a guide 102 is positioned between roller pair 66, 66' and idler roller 90.

A curved guide 104 is positioned below roller pair 60, 60'. In one embodiment, a media sensor 106 is positioned below roller pair 60, 60' along transport path 58 and, as described in greater detail below, is configured to sense a transverse edge of a sheet of imaging media, such as sheet 56.

Pickup assembly 42 includes a driven roller pair 108 positioned between entrance area 74 and third media tray 48, a driven roller pair 110 positioned between entrance area 76 and second media tray 46, and a driven roller pair 112 positioned between entrance area 78 and first media tray 44. In one embodiment, as illustrated, a media sensor 114 is positioned between driven roller pair 108 and third media tray 48 along transport path 54, a media sensor 116 is positioned between driven roller pair 110 and second media tray 46 along transport path 52, and a media sensor 118 is positioned between driven roller pair 112 and first media tray 44 along transport path 50. Similar to media sensor 106, media sensors 114, 116, and 118 are configured to detect a transverse edge of a sheet of imaging media, such as sheet 56. Exposure system 36 includes a driven roller pair 120 and a driven roller pair 122 configured to receive move the registered sheet of imaging media from feeder assembly 32 along transport path 58.

A controller 170 is configured to control the rotation of lower roller pair 60, 60' and the rotation and position (i.e. open/closed) of the plurality of upper roller pairs 62, 62', 64, 64', 66, 66' via control of a dc drive motor and actuating system (not shown). In one embodiment, controller 170 controls the rotation of lower roller pair 60, 60' and the rotation and position (i.e. open/closed) of the plurality of upper roller pairs 62, 62', 64, 64', 66, 66' based on inputs from media sensors 106, 114, 116, and 118. In one embodiment, controller 170 is additionally configured to control other components of imaging apparatus 30, such driven rollers pairs 108, 110, and 112 of pickup assembly 42. While controller 170 may be included as component of feeder assembly 32, in one embodiment, as illustrated by the dashed lines of FIG. 2, controller 170 is a component of imaging apparatus 30 which is separate from feeder assembly 32 and, as known in the art, configured to control any number of processes and components associated with the operation of imaging apparatus 30.

FIG. 3 is a front view illustrating portions of feeder assembly 32 of FIG. 2. As illustrated, guide 70 includes a pair of notches 124 and 126. A pair of positioning arms 128 and 130 having corresponding positioning fingers 132 and 134 are positioned so as to be aligned with notches 124 and 126. As described in greater detail below, positioning arms 128 and 130 are configured to draw the positioning fingers 132 and 134 into corresponding notches 124 and 126 so as to contact lateral edges of a sheet, such as sheet 56, and latterly move and align a sheet 56 with a centerline 160 of transport path 58.

Although described herein as employing a pair of positioning arms and positioning fingers to bias opposing lateral edges of a sheet to center the sheet along the transport path, in other embodiments, a single positioning arm/finger may be employed to bias one lateral edge of a sheet so as to move and align an opposing lateral edge against a stop or guide. In other embodiments, more than one pair of positioning arms/fingers may be employed to laterally align the sheet. Other methods for laterally positioning sheets are known to those skilled in the art. The pair of positioning arms 128, 130 and corresponding positioning fingers 132, 134 described herein assist in reducing the physical dimensions required for feeder assembly 32 relative to other implementations.

Figure 4A:
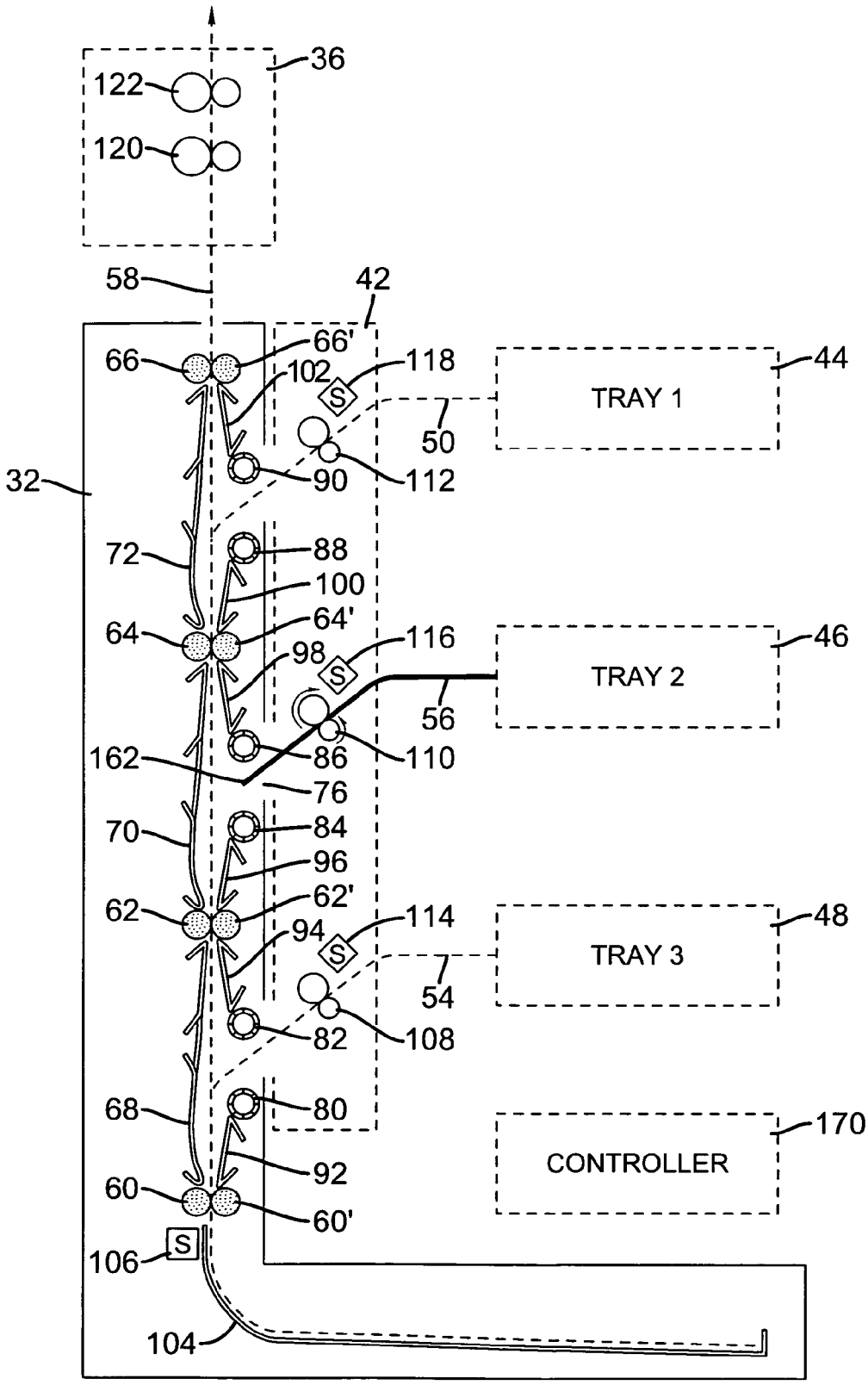
FIGS. 4A-4H show side views illustrating the operation of the feeder assembly of FIGS. 2 and 3.

FIGS. 4A-4H and FIGS. 5A-5D below illustrate one embodiment of the operation of feeder assembly 32 described above by FIGS. 2 and 3. In the illustrated example, feeder assembly 32 is illustrated as receiving and registering a sheet 56 from second media tray 46. With reference to FIG. 4A, initially, pickup assembly 42 extracts and begins transporting sheet 56 from second media tray 46 to feeder assembly 32 through corresponding entrance area 76 via driven roller pair 110. In FIG. 4A, a first transverse edge 162 of sheet 56 is illustrated entering feeder assembly 32 via entrance area 76.

Figure 4B:
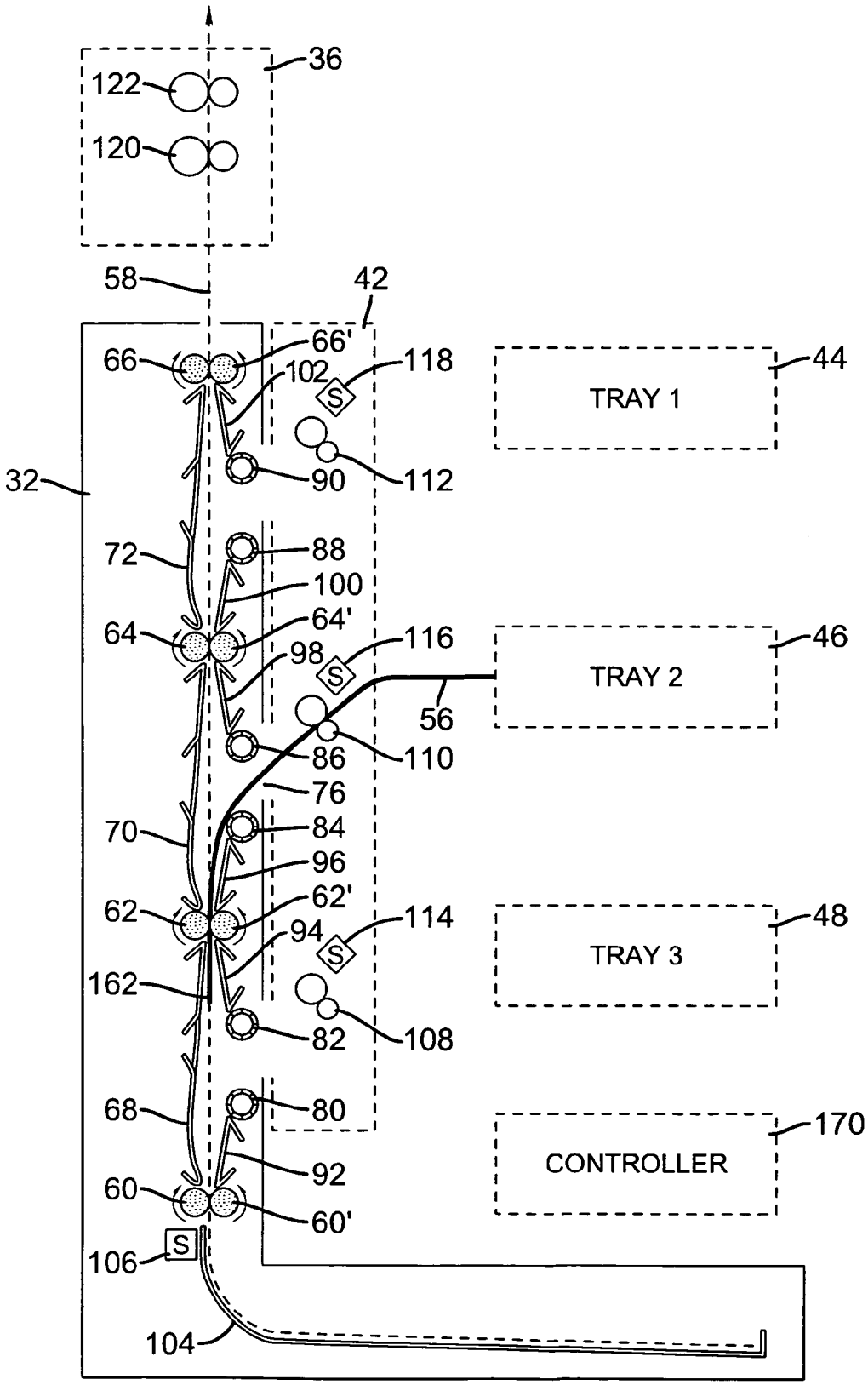

With reference to FIG. 4B, as driven roller pair 110 of pickup assembly 42 continue to transport sheet 56 from second media tray 46 to feeder assembly 32, a curved portion of guide 70 guides first transverse edge 162 to roller pair 62, 62'. As illustrated by FIG. 4B, roller 62' is in the closed position and roller 62 is driven so that roller pair 62, 62' receives first transverse edge 162 and transports sheet 56 vertically downward along transport path 58 toward lower roller pair 60, 60'. As sheet 56 is driven vertically downward toward roller pair 60, 60', sheet 56 comes into contact with and rides on idler roller 84 while media sensor 116 monitors the position of sheet 56 as it travels from second media tray 46 to feeder assembly 32. In one embodiment, as illustrated by FIG. 4B, rollers 64' and 66' are also in the closed position, with lower roller pair 60, 60' and upper roller pairs 64, 64' and 66, 66' also being driven in a direction so as to provide downward propagation along transport path 58 toward guide 104.

Figure 4C:
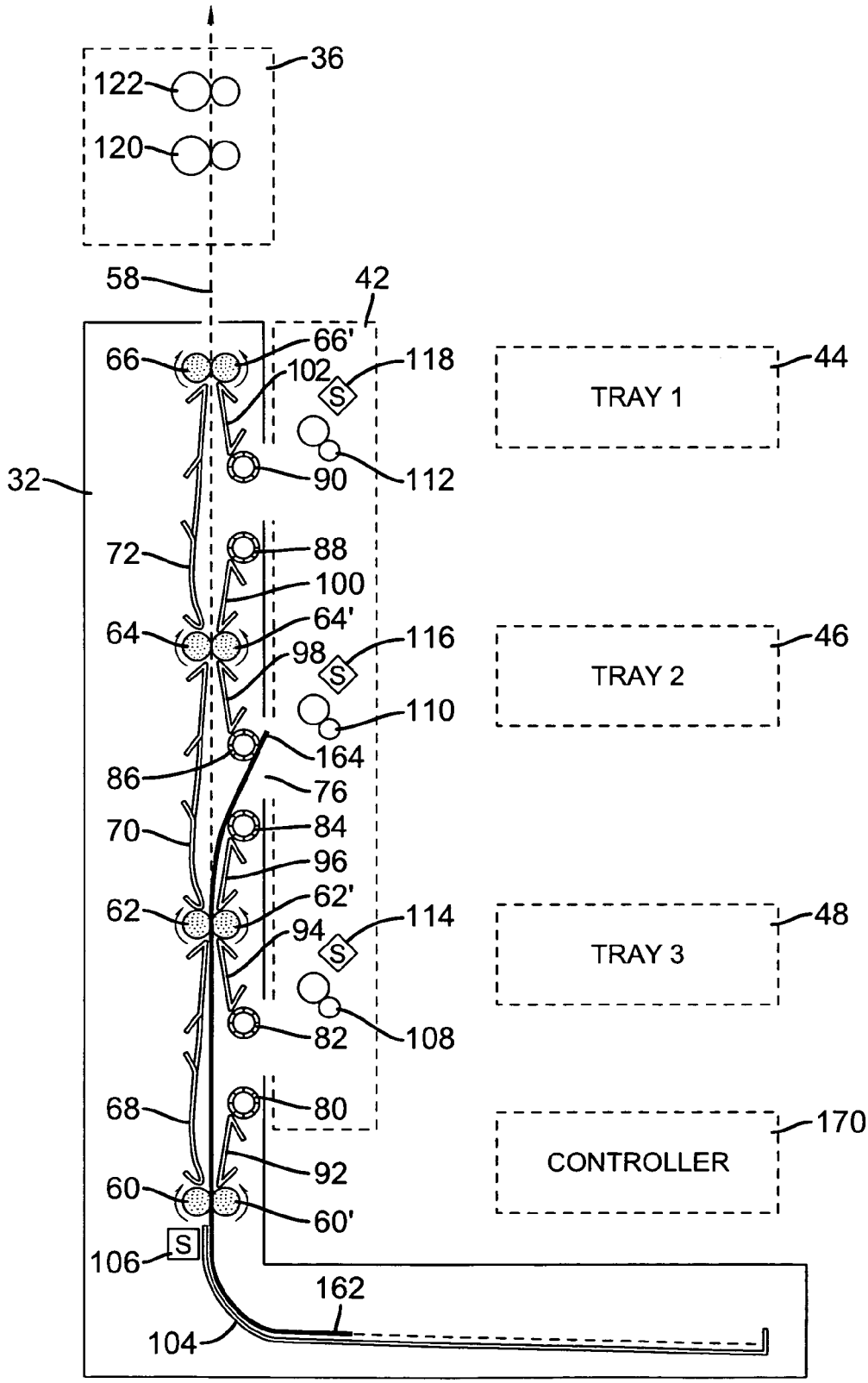

With reference to FIG. 4C, as sheet 56 continues to be transported vertically downward along transport path 58, first transverse edge 162 contacts and is directed in a horizontal fashion by guide 104. Additionally, as sheet 56 continues to be transported downward along transport path 58, a second transverse edge 164 of sheet 56 passes by and is detected by media sensor 116. As illustrated by FIG. 4C, second transverse edge 164 passes through driven roller pair 110 of pickup assembly 42 such that sheet 56 rides on idler rollers 84 and 86. As illustrated, upper rollers 62', 64', and 66' remain in the closed position and lower roller pair 60, 60' and upper roller pairs 62, 62', 64, 64', and 66, 66' continue to be driven in a direction so as to provide downward propagation along transport path 58 toward guide 104.

Figure 4D:
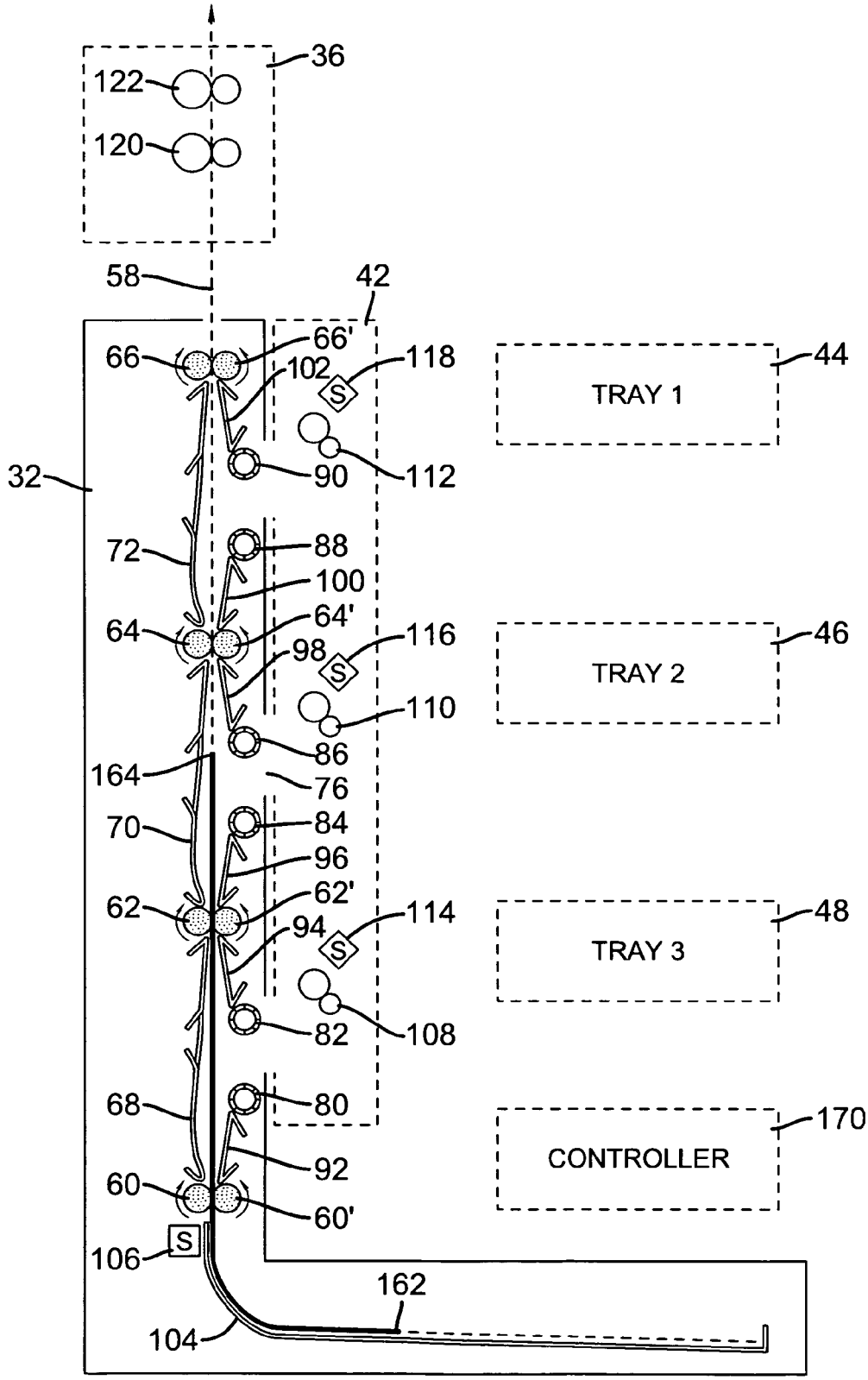

With reference to FIG. 4D, as sheet 56 continues to be driven vertically downward along transport path 58, second transverse edge 164 passes over idler roller 86 and enters into feeder assembly 32 such that sheet 56 no longer rides on idler rollers 84 and 86. In one embodiment, based on a known transport rate of lower roller pair 60, 60' and upper roller pairs 62, 62', 64, 64', and 66, 66', and based on the detection of second transverse edge 164 of sheet 56 by media sensor 116, controller 170 determines when sheet 56 reaches the position generally illustrated by FIG. 4D.

Figure 4E:
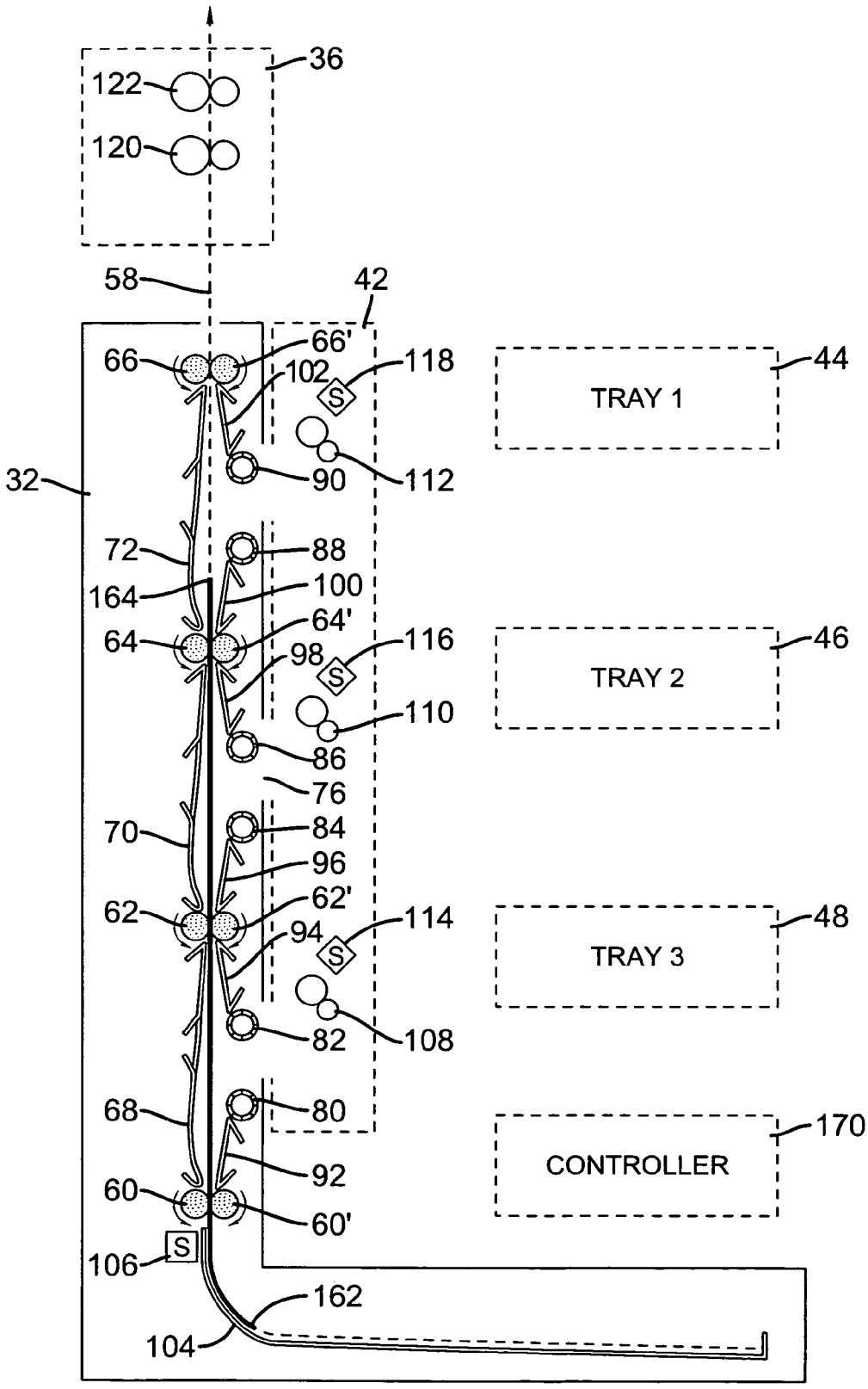

With reference to FIG. 4E, upon sheet 56 reaching the position as generally illustrated by FIG. 4D, controller 170 reverses the direction of lower roller pair 60, 60' and upper roller pairs 62, 62', 64, 64', and 66, 66' so that sheet 56 is driven vertically upward along transport path 58 toward exposure system 36. As illustrated by FIG. 4E, upper rollers 62', 64', and 66' remain in the closed position, but lower roller pair 60, 60' and upper roller pairs 62, 62', 64, 64', and 66, 66' are now driven in a direction so as to provide upward propagation of sheet 56 along transport path 58 toward exposure system 36. As such, first transverse edge 162 becomes a trailing edge and second transverse edge 164 becomes a leading edge of sheet 56 as it moves vertically upward along transport path 58.

Figure 4F:
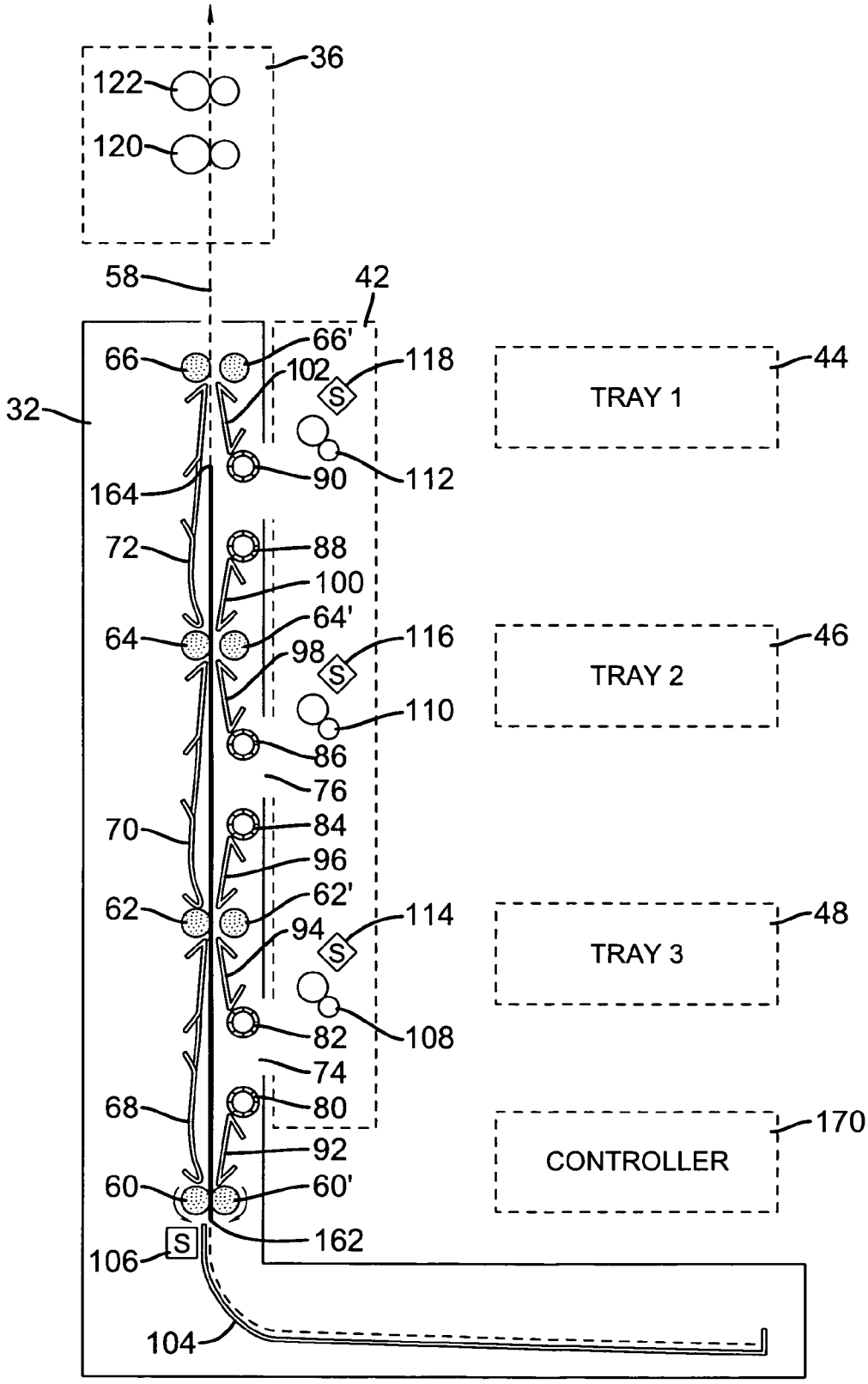

With reference to FIG. 4F, as sheet 56 is transported vertically upward, first transverse edge 162 passes and is detected by media sensor 106. As illustrated by FIG. 4F, in response to media sensor 106 detecting first transverse edge 162 of sheet 56, controller 170 moves idler rollers 62', 64', and 66' to the open position so that upper roller pairs 62, 62', 64, 64', and 66, 66' no longer assist in transporting sheet 56 along transport path 58. Lower roller pair 60, 60' continues to be driven and transport sheet 56 vertically upward along transport path 58. In one embodiment, upper roller pairs 62, 62', 64, 64', and 66, 66' and lower roller pair 60, 60' are coupled to a common drive system (not illustrated) such that driven rollers 62, 64, and 66 continue to rotate when idler rollers 62', 64', and 66' are in the open position.

Figure 5A:
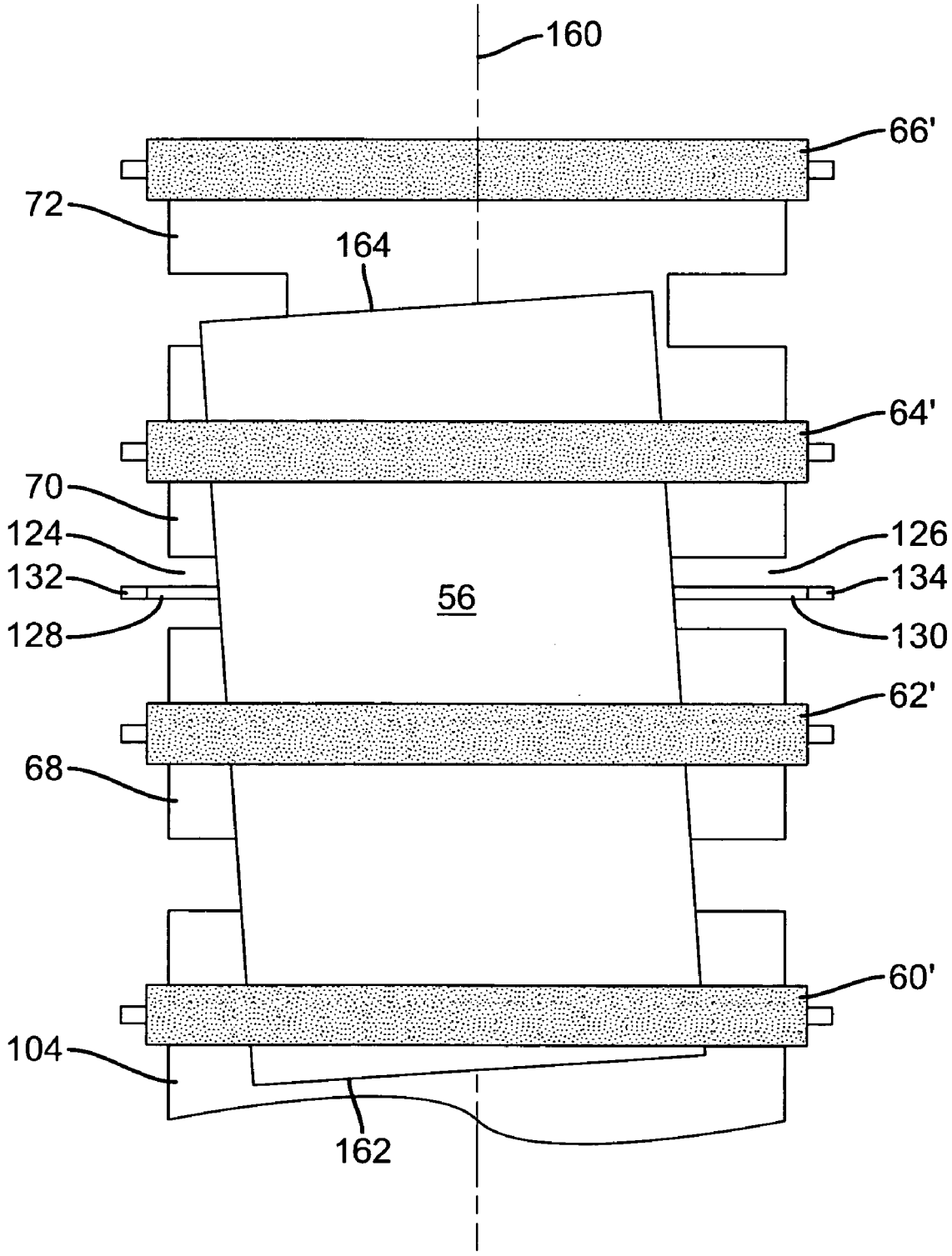
FIGS. 5A-5D illustrate front views illustrating the operation of the feeder assembly of FIGS. 2 and 3.

FIG. 5A is a front view of feeder assembly 32 and shows a position of sheet 56 along transport path 58 corresponding approximately to the position of sheet 56 illustrated in FIG. 4F. As illustrated by FIG. 5A, sheet 56 is longitudinally skewed and laterally off-center with respect to centerline 160 of transport path 58.

Figure 4G:
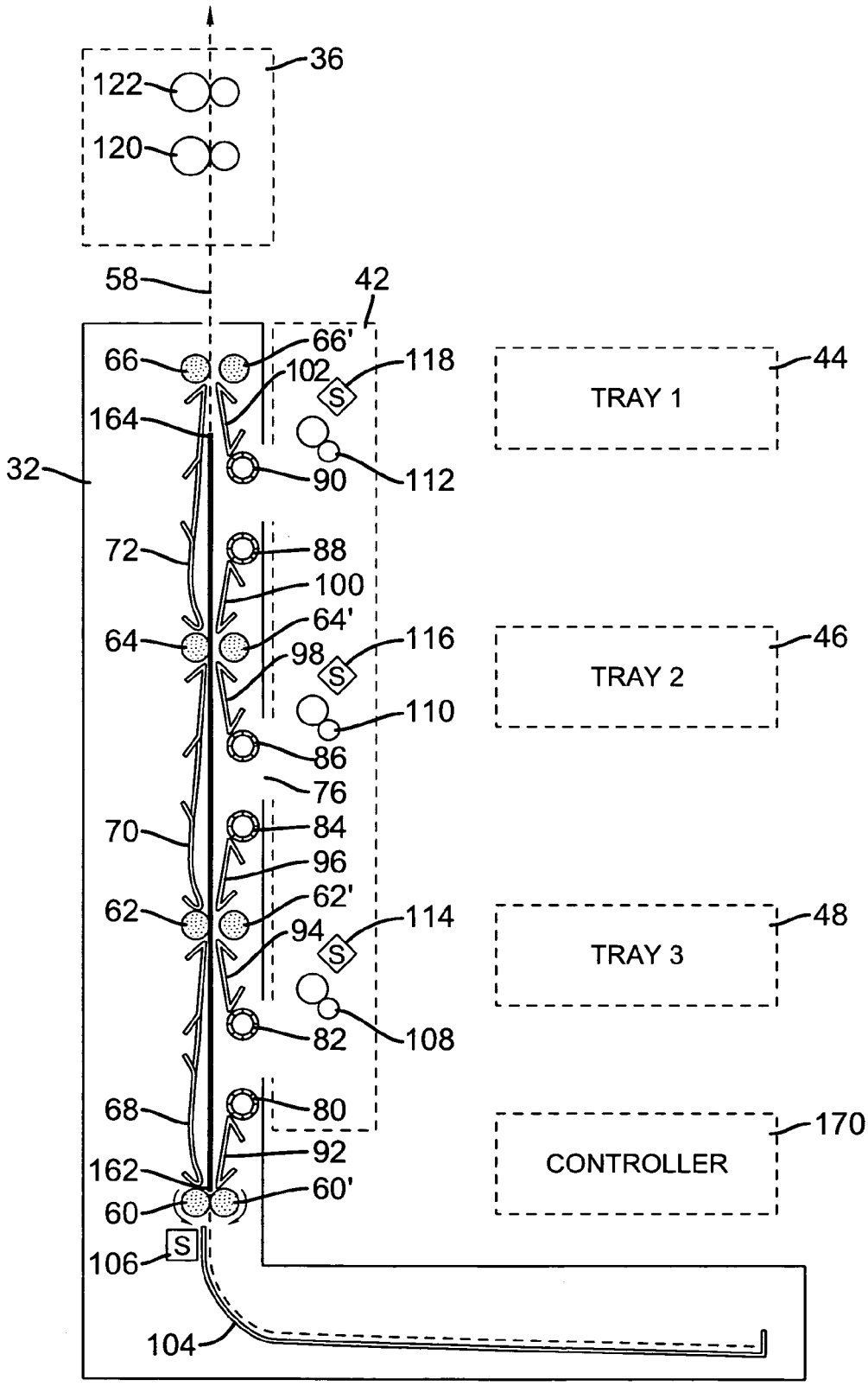
Figure 5B:
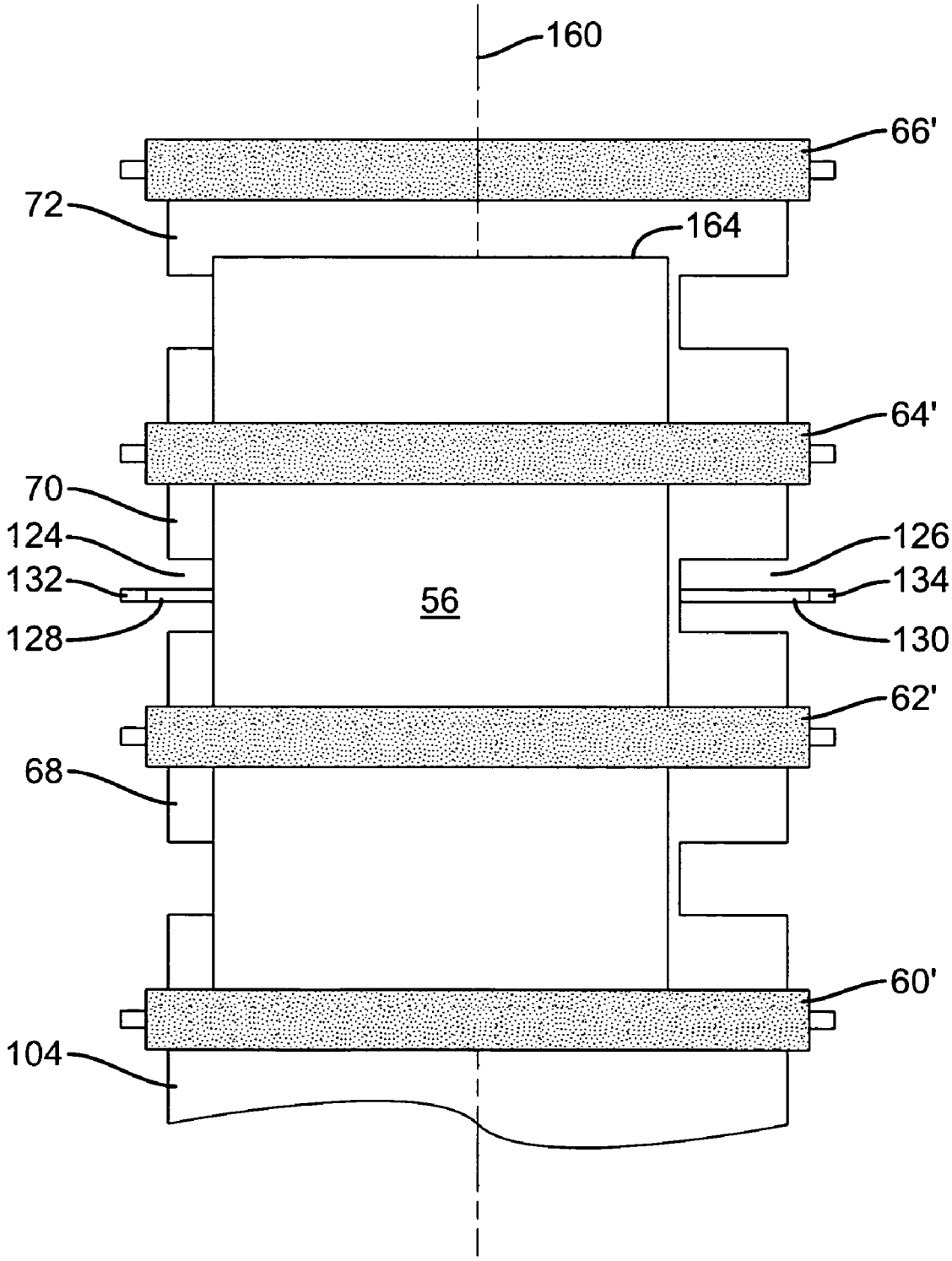

With reference to FIG. 4G, as lower roller pair 60, 60' continues to drive sheet 56 vertically upward along transport path 58, first transverse edge 162 passes through a nip formed by lower roller pair 60, 60' and upward movement of sheet 56 along transport path 58 ceases. With first transverse edge 162 of sheet 56 supported by lower roller pair 60, 60' and sheet 56 being maintained in a substantially vertically position along transport path 58 by upper rollers 62 and 64 and guides 68, 70, 72, 94, 96, 98, and 100, movement of sheet 56 caused by the continued rotation of lower roller pair 60, 60', together with gravity, cause first transverse edge 162 to align with lower roller pair 60, 60' and deskew sheet 56 relative to transport path 58. FIG. 5B is a front view of feeder assembly 32 illustrating a position of sheet 56 along transport path 58 after being longitudinally aligned (i.e. deskewed) with respect to centerline 160.

Figure 5C:
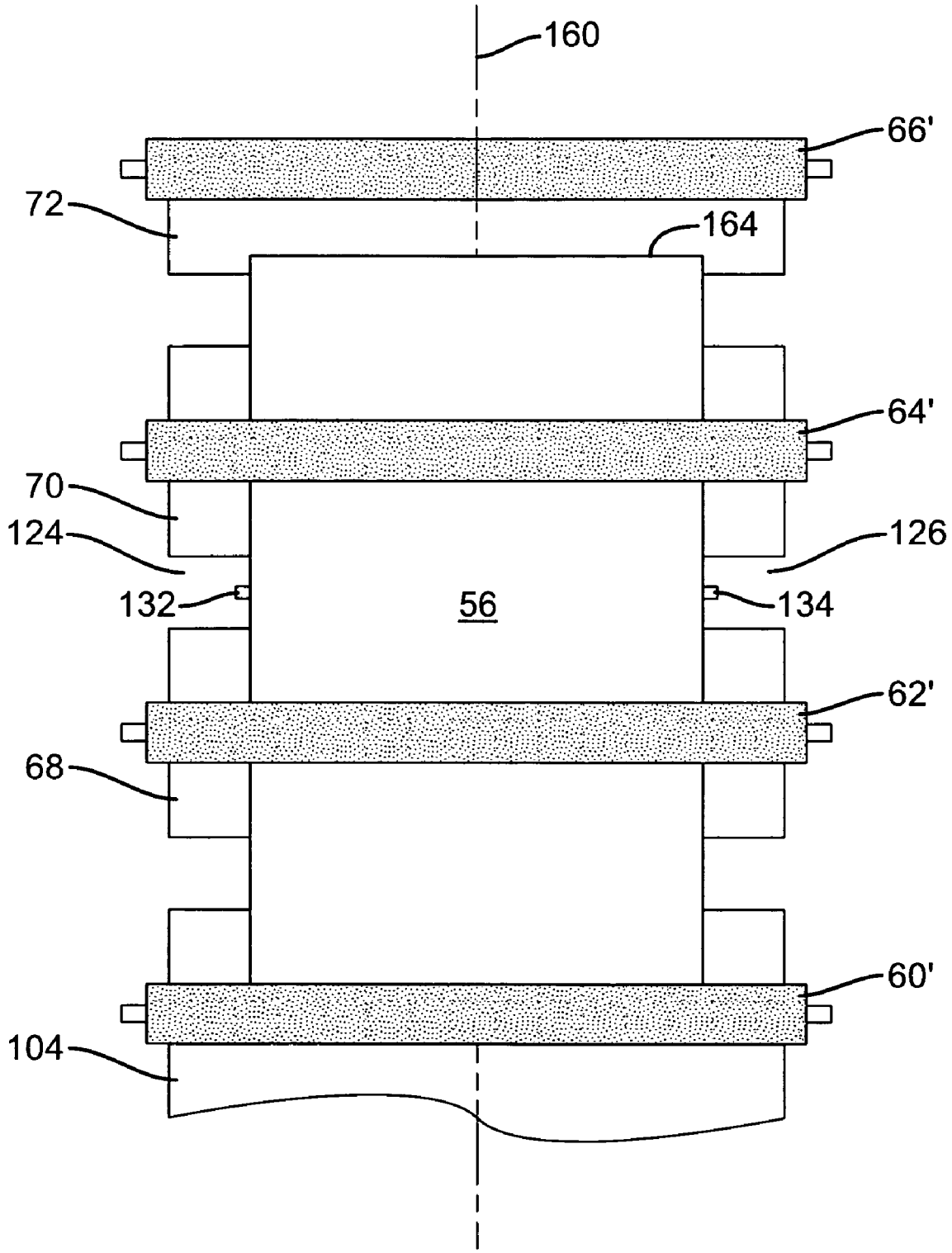

With reference to FIGS. 4G and 5C, in one embodiment, while lower roller pair 60, 60' continues to be driven, positioning fingers 132 and 134 are moved inward toward centerline 160 of transport path 58. Positioning fingers 132 and 134 contact longitudinal edges of sheet 56 and laterally move and center sheet 56 with centerline 160 of transport path 58. In one embodiment, controller 170 moves positioning fingers 132 and 134 inward by a distance based on a known width of sheet 56. In one embodiment, controller 170 determines a width of sheet 56 based on the media tray from which it was received (e.g. first, second, and third media trays 44, 46, and 48). In one embodiment, positioning arms 128 and 130 and corresponding positioning fingers 132 and 134 are maintained at the centering position for a pre-determined duration while lower roller 60, 60' continues to rotate.

Figure 4H:
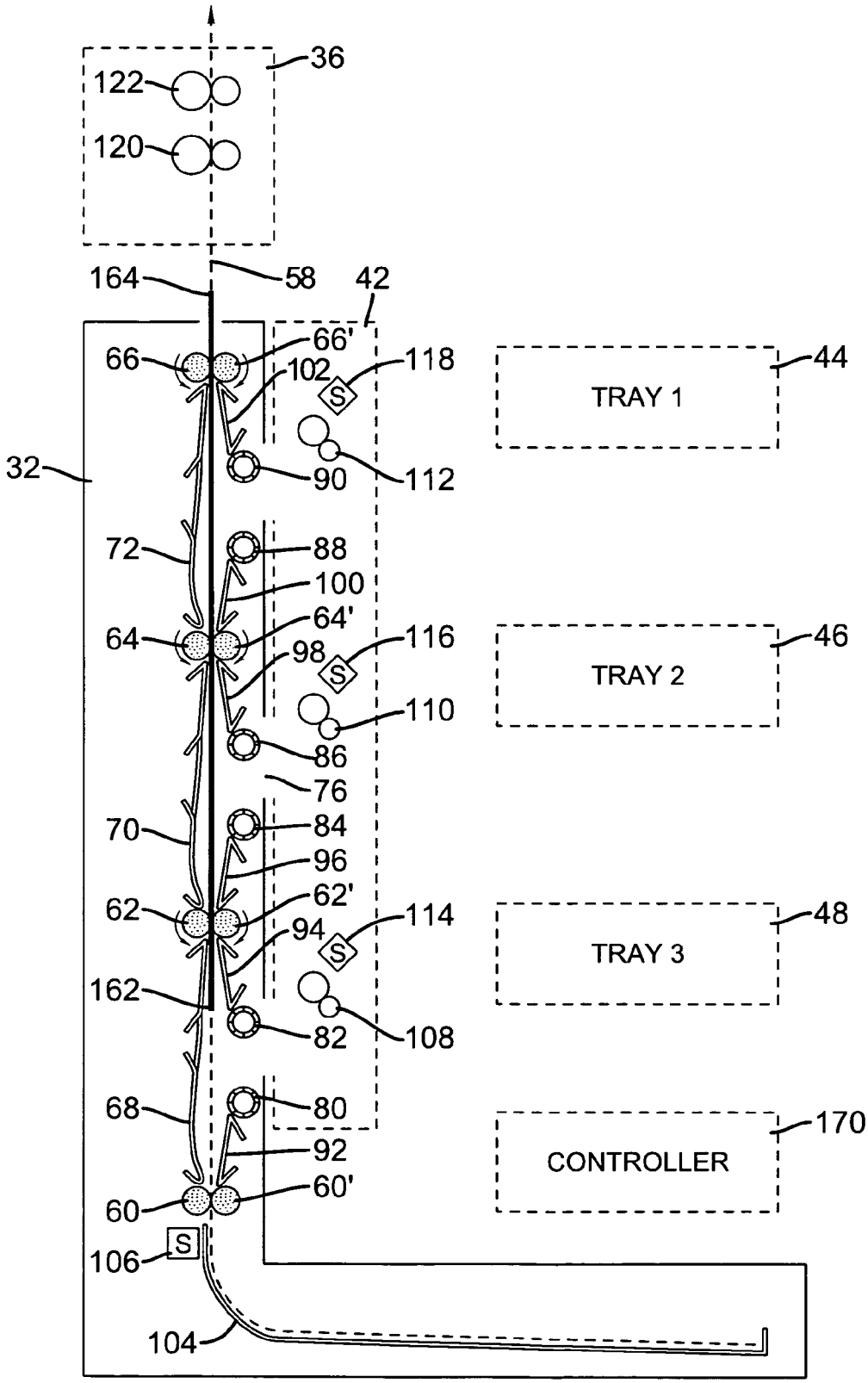

With reference to FIG. 4H, after sheet 56 is longitudinally aligned (i.e. deskewed) and laterally centered with transport path 58, controller 170 stops driving drive rollers 60, 62, 64, and 66, thereby stopping rotation of lower roller pair 60, 60', and retracts positioning fingers 132 and 134 away from centerline 160. In one embodiment, controller 170 stops the driving of driver rollers 60, 62, 64, and 66 and retracts positioning fingers 132 and 134 after a time period determined from the detection of first transverse edge 162 by media sensor 106 and the transport rate of lower roller pair 60, 60'.

Figure 5D:
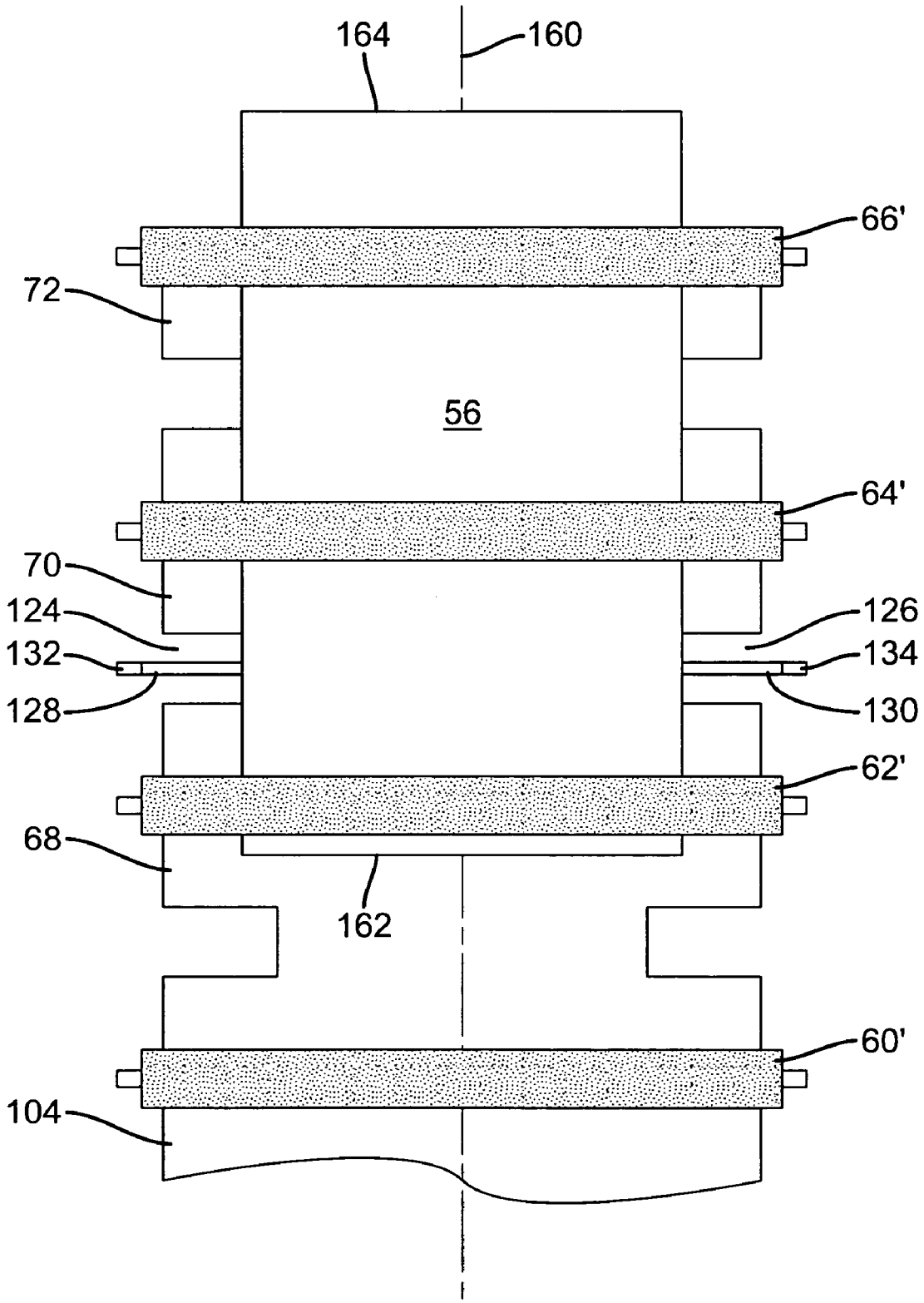

Upper rollers 62', 64', and 66' are subsequently moved to the closed position and drive rollers 60, 62, 64, and 66 are again driven in a direction such that upper roller pairs 62, 62', 64, 64', 66, and 66' transport registered (i.e. deskewed and centered) sheet 56 vertically upward along transport path 58 to exposure system 36. FIG. 5D is a front view of feeder assembly 32 showing a position of sheet 56 along transport path 58 and corresponding approximately to the position of sheet 56 illustrated in FIG. 4H. As illustrated by FIG. 5D, sheet 56 is longitudinally aligned and centered relative to centerline 160 of transport path 58.

The above described process of FIGS. 4A-4H and FIGS. 5A-5D is repeated for each sheet of imaging media received from second media tray 46. Although not illustrated herein, transporting and registration of sheets of imaging media from first and third media trays 44 and 48 is carried out in a similar fashion, with media sensors 114 and 118 detecting a second transverse edge of the sheets of imaging media. Additionally, although illustrated as including first, second, and third media trays 44, 46, and 48, feeder assembly 32 according to embodiments of the present invention can be adapted for use in imaging apparatuses employing more or fewer than three media trays.

As mentioned above, FIGS. 4A-4H and FIGS. 5A-5D above illustrate one embodiment of the operation of feeder assembly 32 according to embodiments of the present invention. Other embodiments are considered within the scope of this invention. For example, in one embodiment, with reference to FIGS. 4G and 5C, after first transverse edge 162 of sheet 56 passes through lower roller pair 60 and 60', rotation of upper roller pairs 62, 62', 64, 64', 66, and 66 and lower roller pair 60, 60' are stopped. Deskewing of sheet 56 relative to transport path 58 is performed by gravity and through movement of sheet 56 by contact with positioning fingers 132 and 134 during the centering process, without movement of lower roller pair 60, 60'. In one embodiment, positioning arms 128 and 130 and corresponding positioning fingers 132 and 134 are maintained at the centering position for a pre-determined duration while upper roller pairs 62, 62', 64, 64', 66, and 66 and lower roller pair 60, 60' are stopped.

In one embodiment, positioning arms 128 and 130 and corresponding positioning fingers 132 and 134 are moved back-and-forth between an open position and a closed centering position multiple times when centering sheet 56 along transport path 58. In one embodiment, positioning arms 128 and 130 and corresponding positioning fingers 132 and 134 are moved back-and-forth between an open position and the centering position twice when centering sheet 56 along transport path 58. In one embodiment, rotation of upper roller pairs 62, 62', 64, 64', 66, and 66 and lower roller pair 60, 60' are stopped during only the first closing of positioning fingers 132 and 134. In one embodiment, rotation of upper roller pairs 62, 62', 64, 64', 66, and 66 and lower roller pair 60, 60' are stopped during only the second closing of positioning fingers 132 and 134. In one embodiment, rotation of upper roller pairs 62, 62', 64, 64', 66, and 66 and lower roller pair 60, 60' are stopped during both closings of positioning fingers 132 and 134.

By employing the above described vertical sheet registration techniques according to embodiments of the present invention, feeder assembly 32 deskews and laterally aligns sheet 56 without sheet 56 departing from transport path 58, thereby reducing the time necessary to register sheet 56 relative to transport path 58. Also, by simultaneously deskewing and laterally positioning sheet 56, the time required to register sheet 56 is further reduced. Additionally, registering sheet 56 without departing from transport path 58 reduces the physical dimensions of feeder assembly 32.

In one embodiment, the surfaces of rollers 60 and 60' comprise a low-static, low-friction, non-compressive material. In one embodiment, the surfaces of rollers 60 and 60' comprise an acetal plastic material, such as Delrin®, for example. The low-friction surfaces reduce the force required to deskew and center the sheet, and reduce the potential that the trailing edge of the sheet from being damaged or catching on the rollers. The non-compressive properties reduce the potential for velocity mismatches along the rollers, thereby reducing skewing of the sheet. In one embodiment, drive rollers 62, 64, and 66 of the upper roller pairs have surfaces comprising stainless steel, and moveable idler rollers 62', 64", and 66 of the upper roller pairs have surfaces comprising a urethane material.

Figure 6A:
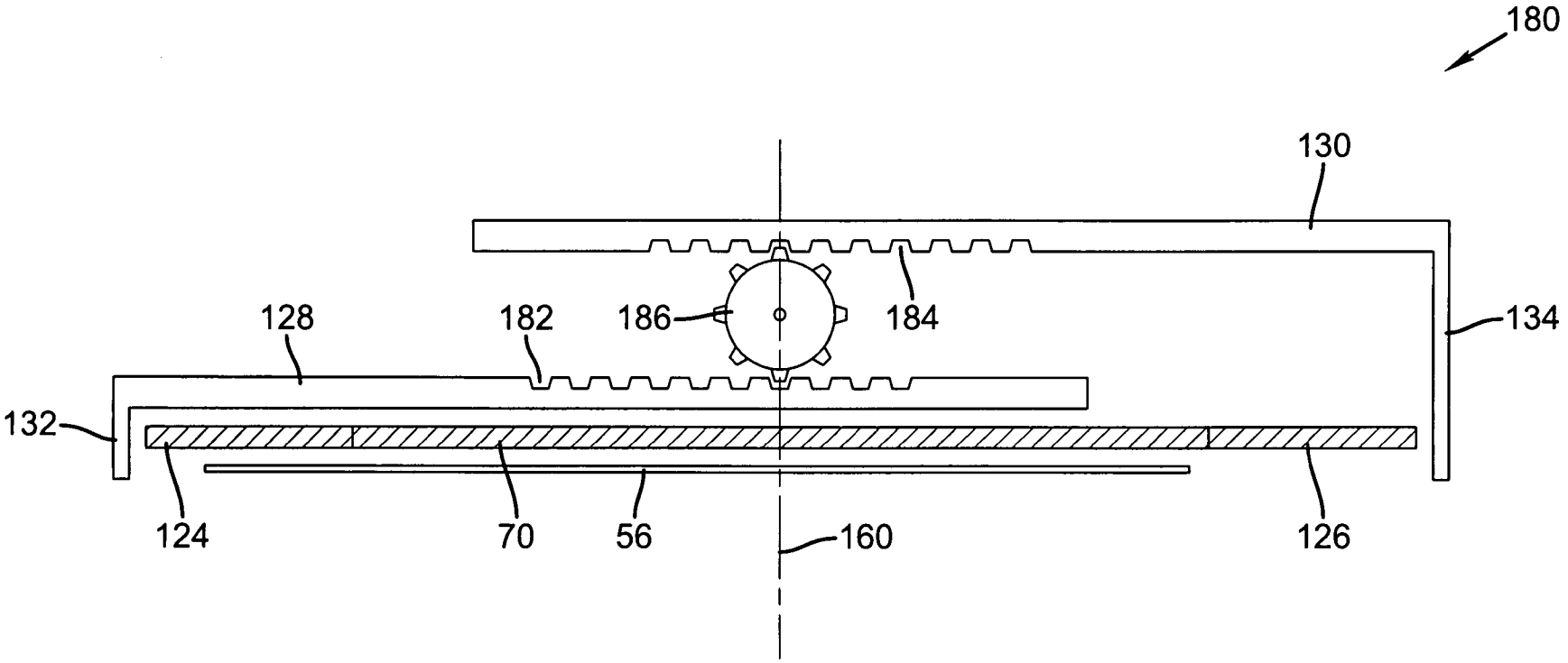
FIGS. 6A-6B illustrate one embodiment of a lateral aligning system employed by the feeder assembly of FIGS. 2 and 3.
Figure 6B:
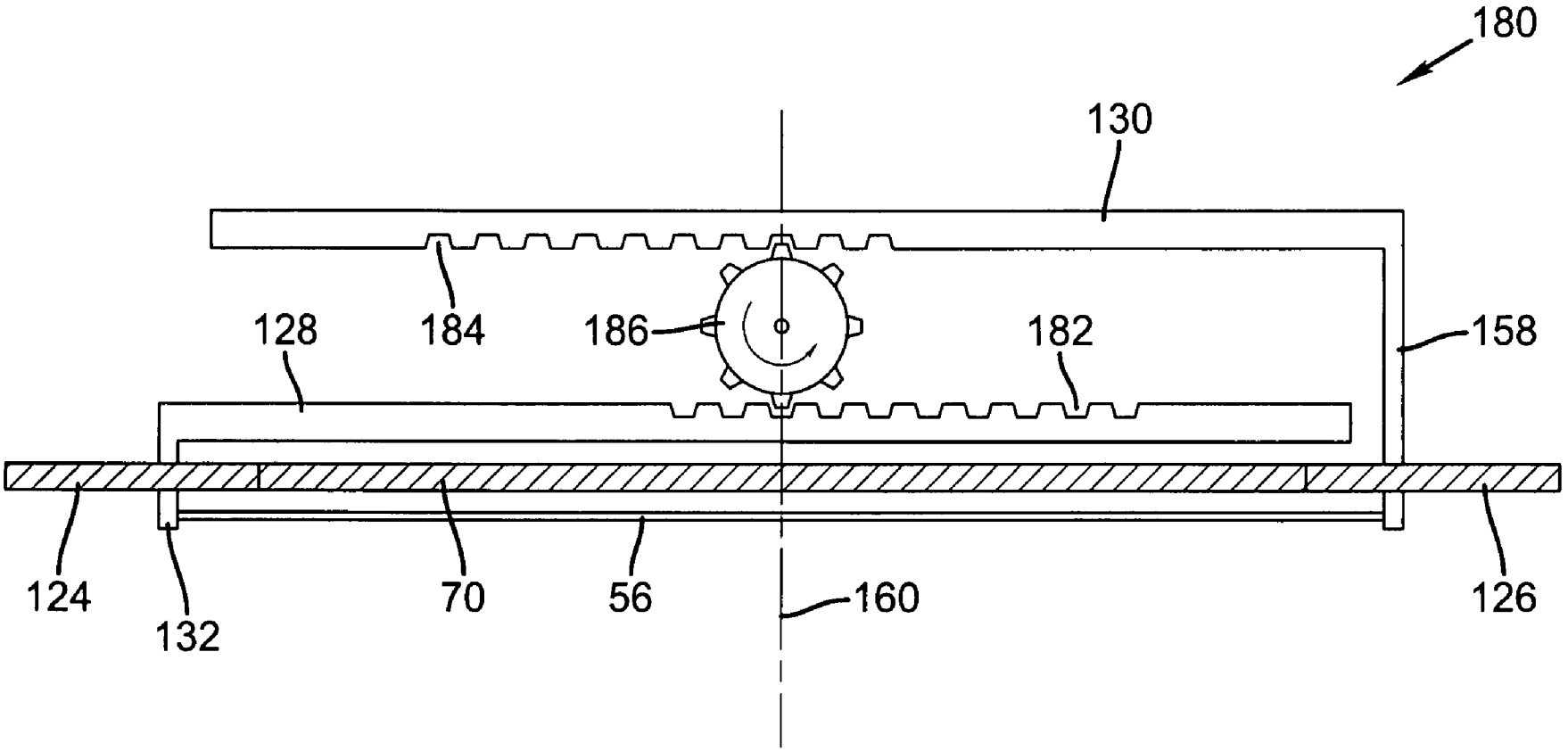

FIGS. 6A and 6B are top views generally illustrating portions of one embodiment of a lateral positioning assembly 180 employed by feeder assembly 32 for centering a sheet of imaging media, such as sheet 56, along centerline 160 of transport path 58. Positioning assembly 180 includes positioning arms 128, 130 and corresponding positioning fingers 132, 134. Positioning arms 128 and 130 respectively include gear racks 182 and 184 that are configured to interact with a central gear 186. FIG. 6A shows positioning arms 128, 130 and corresponding positioning fingers 132, 134 in a retracted position, away from centerline 160 of transport path 58. With reference to FIG. 6B, central gear is rotated in a counter-clockwise direction to draw positioning arms 128, 130 and corresponding positioning fingers 132, 134 inward toward centerline 160. Positioning fingers 132 and 134 respectively travel within notches 124 and 126 to contact the lateral edges of sheet 56 to move and center sheet 56 along centerline 160.

Figure 7:
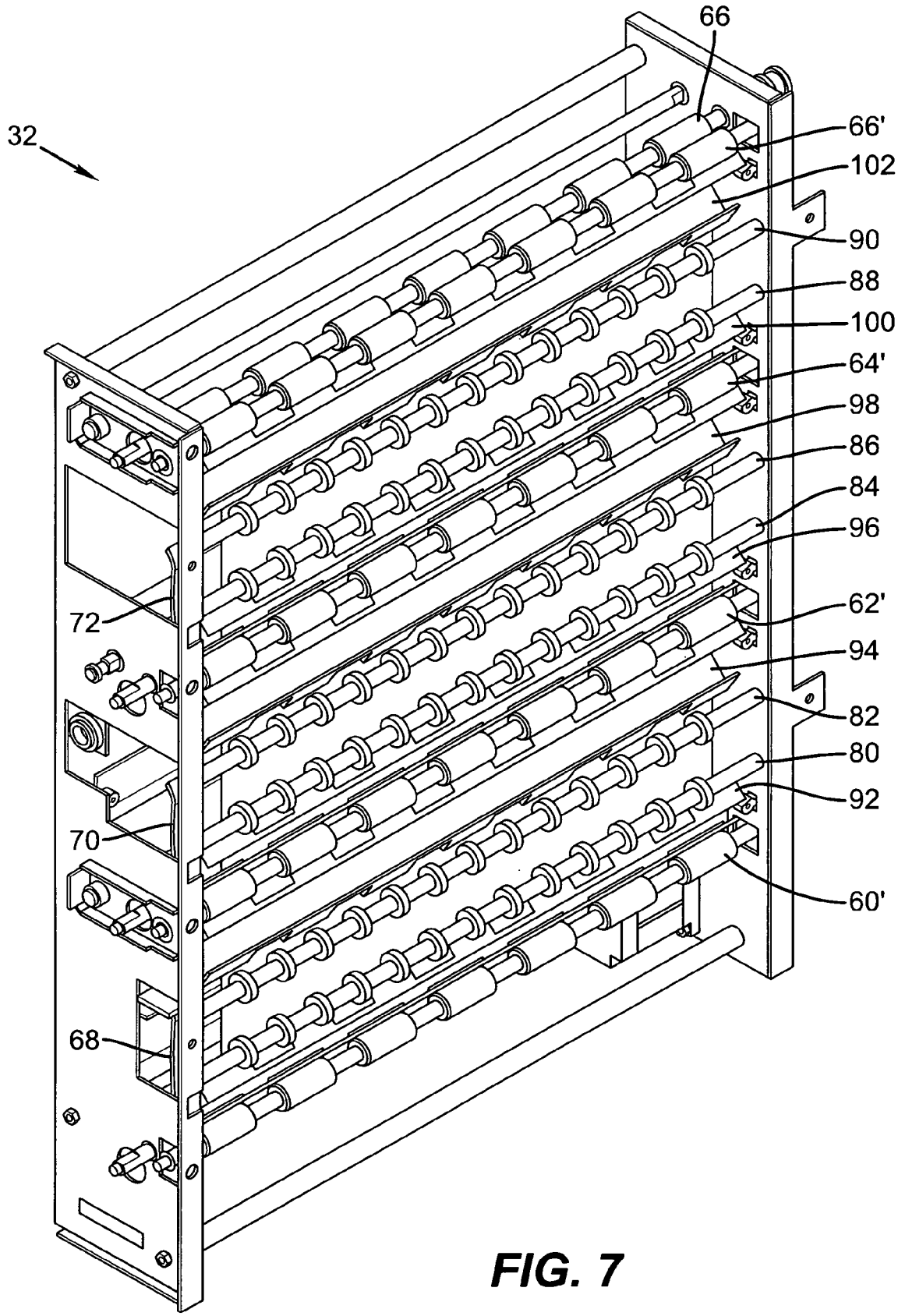
FIG. 7 illustrate a perspective view of one embodiment of a feeder assembly according to embodiments of the present invention.

FIG. 7 is a perspective view illustrating portions of one embodiment of feeder assembly 32 according to the present invention.

A computer program product may include one or more storage medium, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

PARTS LIST

30 Imaging Apparatus
32 Feeder Assembly
34 Media Supply System
36 Exposure System
38 Processing System
40 Output System
42 Pickup Assembly
44 Media Tray

46 Media Tray
48 Media Tray
50 Transport Path
52 Transport Path
54 Transport Path
56 Sheet of Imaging Media
58 Transport Path
60, 60' Lower Driven Roller Pair
62, 62' Upper Driven Roller Pair
64, 64' Upper Driven Roller Pair
66, 66' Upper Driven Roller Pair
68 Guide
70 Guide
72 Guide
74 Entrance Area
76 Entrance Area
76 Entrance Area
80 Idler Roller
82 Idler Roller
84 Idler Roller
86 Idler Roller
88 Idler Roller
90 Idler Roller
92 Guide
94 Guide
96 Guide
98 Guide
100 Guide
102 Guide
104 Guide
106 Media Sensor
108 Driven Roller Pair
110 Driven Roller Pair
112 Driven Roller Pair
114 Media Sensor
116 Media Sensor
118 Media Sensor
120 Driven Roller Pair
122 Driven Roller Pair
124 Guide Notch
126 Guide Notch
128 Positioning Arm
130 Positioning Arm
132 Positioning Finger
134 Positioning Finger
160 Centerline of Transport Path
162 First Transverse Edge of Sheet 56
164 Second Transverse Edge of Sheet 56
170 Controller
180 Lateral Positioning Assembly
182 Gear Rack
184 Gear Rack
186 Gear

What is claimed is:

1. A method for deskewing a sheet, the method comprising:

positioning a lower roller pair and at least one upper roller pair to form a substantially vertical transport path, wherein the lower roller pair and at least one upper roller pair each form a nip;

driving the lower roller pair and the at least one upper roller pair so as to transport a sheet upward along the substantially vertical transport path;

opening the nip formed by the at least one upper roller pair as a trailing edge of the sheet approaches the lower roller pair; and continuing to drive the lower roller pair so that the trailing edge passes through the nip formed by the lower roller pair and upward movement of the sheet ceases with the trailing edge supported by the lower roller pair, wherein gravity and movement of the sheet caused by continued rotation of the lower roller pair work together to align the trailing edge with the nip of the lower roller pair.

2. The method of claim 1, further comprising moving the sheet laterally to a desired lateral position relative to the substantially vertical transport path.

3. The method of claim 2, comprising temporarily stopping the driving of the lower roller pair and the at least one upper roller pair while moving the sheet laterally.

4. The method of claim 2, wherein moving the sheet laterally comprises substantially centering the sheet on a centerline of the substantially vertical transport path.

5. The method of claim 2, wherein moving the sheet laterally comprises substantially aligning a lateral edge of the sheet with the desired lateral position.

6. The method of claim 2, further comprising:

stopping the driving of the lower roller pair and the at least one upper roller pair after the trailing edge is aligned with the lower roller pair and moved to the desired lateral position;

closing the nip formed by the at least one upper roller pair; and restarting the driving of the lower roller pair and the at least one upper roller pair so as to transport the aligned sheet upward along the substantially vertical transport path.

7. The method of claim 2, wherein moving the sheet laterally includes biasing a lateral edge of the sheet.

8. A sheet registration apparatus comprising:

a driven lower roller pair and at least one driven upper roller pair positioned to form a substantially vertical transport path; and a controller configured to drive the lower roller pair and the at least one upper roller pair to transport a sheet upward along the substantially vertical transport path; to open a nip formed by the at least one upper roller pair and to stop driving the at least one upper roller pair as a trailing edge of the sheet approaches the lower roller pair, and to continue to driving the lower roller pair as the trailing edge passes through a nip formed by the lower roller pair such that upward movement of the sheet ceases with the trailing edge supported by the lower roller pair so that gravity and continued rotation of the lower roller pair together align the trailing edge with the lower roller pair.

9. The apparatus of claim 8, further comprising at least one positioning finger configured to bias a lateral edge of the sheet to laterally move the sheet to a desired lateral position relative to the substantially vertical transport path while lower the roller pair continues to rotate.

10. The apparatus of claim 9, wherein at least one positioning finger is configured to align an opposing lateral edge of the sheet with a desired lateral position relative to the substantially vertical transport path.

11. The apparatus of claim 9, comprising at least one pair of positioning fingers configured to bias opposing lateral edges of the sheet to laterally move and substantially center the sheet on a centerline of the substantially vertical transport path.

12. The apparatus of claim 8, wherein the controller is further configured to stop driving of the lower roller pair and the at least one upper roller pair after the trailing edge is aligned with the lower roller pair and moved to the desired lateral position, to close the nip formed by the at least one upper roller pair, and to restart driving of the lower roller pair and the at least one upper roller pair so as to transport the aligned sheet upward along the substantially vertical transport path.

13. The apparatus of claim 8, wherein surfaces of the lower roller pair comprise a material having non-compressive properties.

14. The apparatus of claim 8, wherein surfaces of the lower roller pair comprises an acetal material.

15. The apparatus of claim 8, wherein at least one upper roller pair comprises a stationary driven roller and a moveable idler roller.

16. The apparatus of claim 15, wherein the stationary driven roller comprises a stainless steel surface and the moveable idler roller comprises a urethane surface.

17. The apparatus of claim 8, comprising a sheet sensor positioned below the lower roller pair and configured to detect the trailing edge of the sheet, wherein the controller is configured to determine when the trailing edge passes through the nip formed by the lower roller pair based on detection of the trailing edge by the sheet sensor and on a transport rate of the lower roller pair.

18. A method for deskewing a sheet, the method comprising:

positioning a lower roller pair and at least one upper roller pair to form a substantially vertical transport path, wherein the lower roller pair and at least one upper roller pair each form a nip;

driving the lower roller pair and the at least one upper roller pair so as to transport a sheet upward along the substantially vertical transport path;

opening the nip formed by the at least one upper roller pair as a trailing edge of the sheet approaches the lower roller pair;

stopping the driving of the at least one upper roller pair and the lower roller pair upon the trailing edge passing through the nip formed by the lower roller pair so that upward movement of the sheet along the substantially vertical transport path ceases with the trailing edge supported by the lower roller pair; and moving the sheet laterally to laterally align the sheet with a desired lateral position relative to the substantially vertical transport path by biasing at least one lateral edge of the sheet, wherein the moving and gravity together work to align the trailing edge with the lower roller pair and deskew the sheet relative to the substantially vertical transport path.

19. The method of claim 18, further comprising:

closing the nip formed by the at least one upper roller pair; and restarting the driving of the lower roller pair and the at least one upper roller pair so as to transport the laterally aligned and deskewed sheet upward along the substantially vertical transport path.

20. A method for deskewing a sheet, the method comprising:

positioning a lower roller pair and at least one upper roller pair to form a substantially vertical transport path, wherein the lower roller pair and at least one upper roller pair each form a nip;

driving the lower roller pair and the at least one upper roller pair so as to transport a sheet upward along the substantially vertical transport path;

opening the nip formed by the at least one upper roller pair as a trailing edge of the sheet approaches the lower roller pair; and stopping the lower roller pair after the trailing edge passes through the nip formed by the lower roller pair so that upward movement of the sheet ceases with the trailing edge supported by the lower roller pair; and biasing at least one lateral edge of the sheet to center the sheet longitudinally along the transport path, wherein gravity and movement of the sheet caused by the biasing work together to align the trailing edge with the nip formed by the lower roller pair.

* * * * *